US009279635B2

(12) United States Patent
Torbett

(10) Patent No.: US 9,279,635 B2
(45) Date of Patent: Mar. 8, 2016

(54) ADJUSTABLE ARCHERY SUPPORT SYSTEM

(71) Applicant: Charlton Rhodes Torbett, Watkinsville, GA (US)

(72) Inventor: Charlton Rhodes Torbett, Watkinsville, GA (US)

( * ) Notice: Subject to any disclaimer, the term of this patent is extended or adjusted under 35 U.S.C. 154(b) by 0 days.

(21) Appl. No.: 14/463,715

(22) Filed: Aug. 20, 2014

(65) Prior Publication Data

US 2014/0352679 A1 Dec. 4, 2014

Related U.S. Application Data

(63) Continuation-in-part of application No. 13/429,979, filed on Mar. 26, 2012, now Pat. No. 8,839,774.

(51) Int. Cl.
*F41B 5/00* (2006.01)
*F41B 5/14* (2006.01)

(52) U.S. Cl.
CPC ..... *F41B 5/1426* (2013.01); *F41B 5/1453* (2013.01)

(58) Field of Classification Search
CPC ..... F41B 5/066; F41B 5/148; F41B 5/1484; F41C 27/00; F16M 13/00; F16M 11/04; F16M 11/046; F16M 11/26
See application file for complete search history.

(56) References Cited

U.S. PATENT DOCUMENTS

| | | | | |
|---|---|---|---|---|
| 1,112,732 | A * | 10/1914 | Uhl | 42/94 |
| 3,584,821 | A * | 6/1971 | Glebe | F41A 23/04 248/156 |
| 5,937,560 | A * | 8/1999 | Beltz | 42/94 |
| 7,434,773 | B1 | 10/2008 | Minjares | |
| 7,565,762 | B2 * | 7/2009 | Lackey | F41A 23/06 211/64 |
| 8,771,154 | B2 * | 7/2014 | Fedriga | A63B 21/026 482/122 |
| 2010/0018512 | A1 | 1/2010 | Sandel | |
| 2010/0269393 | A1 * | 10/2010 | Bean | 42/94 |

* cited by examiner

*Primary Examiner* — Alvin Hunter
*Assistant Examiner* — Amir Klayman
(74) *Attorney, Agent, or Firm* — Matthew T. Hoots

(57) ABSTRACT

An exemplary adjustable archery support system is disclosed. An exemplary system comprises an offset brake housing for mechanically interfacing the adjustable archery support system to a support post that provides a stable support for the archery bow from the ground. The offset brake housing positions the support post substantially to a side of the archery bow and out of the line of sight for the archer shooting the bow. When an actuator lever is pulled by the archer, its causes actuation, via a linkage, of an internal brake so that the entire system (and therefore the bow to which the system is mechanically attached) may be adjusted up and down the support post. Once positioned, the user may release the first actuator lever, thereby allowing the internal brake to reengage with the exterior surface of the support post so that the bow is stabilized and supported for a shot.

7 Claims, 17 Drawing Sheets

ADJUSTABLE ARCHERY SUPPORT SYSTEM

CROSS-REFERENCE TO RELATED APPLICATIONS

This application is a continuation-in-part of the U.S. application for patent filed on Mar. 26, 2012, entitled COUPLER FOR ATTACHING AN ARCHERY BOW TO AN ADJUSTABLE FIREARM SHOOTING SUPPORT and assigned Ser. No. 13/429,979, the entire contents of which are hereby incorporated by reference.

BACKGROUND

This invention provides archers with the ability to aim more accurately by adjusting the supported aiming point while at full draw. In any shooting sport, accuracy is the principal objective of the shot. Whether shooting a rifle, pistol or any type of traditional archery equipment, a supported shot is always more accurate than one made freehand or otherwise unsupported. When sighting a rifle, the shooter will typically set up some type of rest or shooting bench to prevent movement of the firearm. When hunting, the hunter will attempt to find some type of natural rest such as a tree limb, stump or rock or utilize a commercial support device to support the firearm prior to making a kill shot.

For years manufacturers have produced commercial firearm shooting support products to address the need for accuracy when target shooting or hunting. There are some very rudimentary devices for traditional archery, but none gives the archer the ability to adjust the aiming point while at full draw. Advantageously, embodiments of an Adjustable Archery Support System addresses this very important need by giving the archer the ability to make sight alignment adjustments for a supported shot while at full draw.

The most common archery aiming sight setup consists of one to six aiming pins, aligned either vertically or horizontally, and mounted in the sight window of the bow, just above the handgrip, and a second aiming point mounted on the bow string at the point where the string comes closest to the archers aiming eye while at full draw. The string mounted device, commonly called a peep sight, is usually a round or oval shaped disc with a hole in its center that is mounted on the string by evenly separating the strands of the string, inserting the disc and tying it off at the top and bottom, as depicted in FIG. 5. When the two sights are properly adjusted, the archer should be able to line up the selected front pin with the target while looking through the string-mounted peep sight at full draw. This front to rear alignment is the same concept used with firearms with one sight mounted at the muzzle on the barrel and one sight mounted at the breech end of the barrel in front of the shooters aiming eye. When both sights are aligned with the target, accuracy is greatly improved.

Alignment is relatively simple with a firearm when using a shooting support or shooting stick. Aiming adjustments are easy with a firearm because once the firearm is supported at the forearm or muzzle end, only one hand is needed to hold the weapon secure at the butt end thereby leaving the other hand free to adjust the shooting rest up, down, right or left, as needed, to align with the target. Even after cocking the weapon, the characteristics of the front and rear sights do not change. In other words, there is no difference in aiming a firearm that is cocked and ready to shoot versus one that is not.

This is not true for traditional archery. The front and rear sights on a bow are not aligned when the bow is not at full draw. Target and sight alignment cannot be achieved until the bow is at full draw. In order to cock or pull the bow, both of the archer's hands are required throughout release of the arrow toward the target. Holding a firearm in the cocked position is performed by a mechanical, spring-loaded device inside the weapon. With a bow, the archer's hands and arms perform this function. Since both hands are required to hold the bow at full draw, which is the only position where sight alignment can occur, as shown by the arrow in FIG. 6, it is impossible to make full draw sight adjustments from a supported shooting position because one hand would have to be removed from either the bow handle or the string to make an adjustment to the support. This would cause full draw to be lost or would uncock the bow and make the shot impossible, as shown by the arrow in FIG. 7. This is where embodiments of an Adjustable Archery Support System are unique, because with prior shooting support configurations, supported full draw sighting adjustments are not possible.

With an Adjustable Archery Support System, the archer can easily make fluid and smooth sighting adjustments while at full draw, never removing either hand from the bow or the string. This gives the archer a virtually unlimited and supported vertical and horizontal range of movement for sight adjustment with the ability to make supported shots that are exponentially more accurate.

BRIEF SUMMARY OF THE INVENTION

An exemplary adjustable archery support system comprises an adapter configured to mount on a riser of an archery bow such that the adjustable archery support system is positioned ahead of the archery bow relative to an archer using the archery bow. The system further comprises an offset brake housing for mechanically interfacing the adjustable archery support system to a support post that provides a stable support for the archery bow from the ground. The offset brake housing positions the support post substantially to a side of the archery bow and out of the line of sight for the archer shooting the bow. The offset brake housing comprises an internal brake operable to engage the support post on its exterior surface. The exemplary system comprises a first actuator lever pivotally connected to its actuator housing and extending upwardly and outwardly therefrom. A linkage resides within the actuator housing and is connected to the first actuator lever at one end and to the internal brake at the other end. When the first actuator lever is pulled by the archer, its causes actuation, via the linkage, of the internal brake so that the entire system (and therefore the bow to which the system is mechanically attached) may be adjusted up and down the support post. Once positioned, the user may release the first actuator lever, thereby allowing the internal brake to reengage with the exterior surface of the support post so that the bow is stabilized and supported for a shot.

BRIEF DESCRIPTION OF THE SEVERAL VIEWS OF THE DRAWINGS

In the drawings, like reference numerals refer to like parts throughout the various views unless otherwise indicated. For reference numerals with letter character designations such as "23B", the letter character designations may differentiate a part or element from a like part or element that is identified in the figures by the same reference numeral sans the letter character.

DETAILED DESCRIPTION OF THE INVENTION

Figure 1:
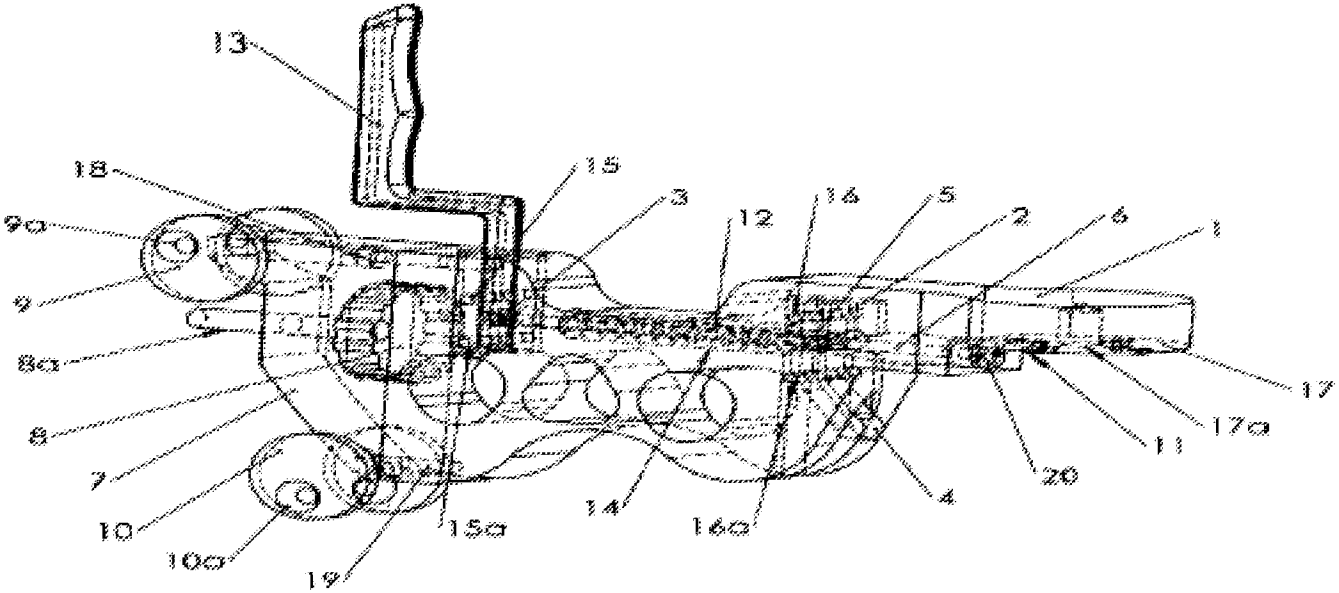
FIG. 1 is a transparent perspective view of one embodiment of an Adjustable Archery Support System.
Figure 2:
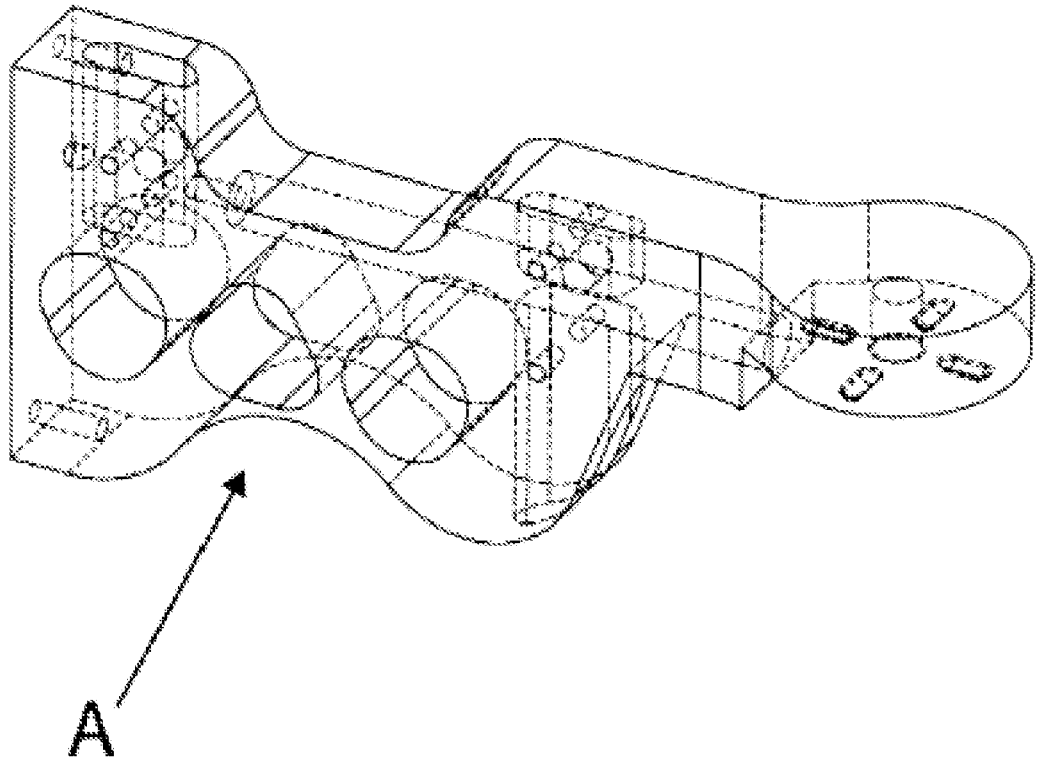
FIG. 2 is a transparent perspective view of the actuator housing of the FIG. 1 embodiment.
Figure 3:
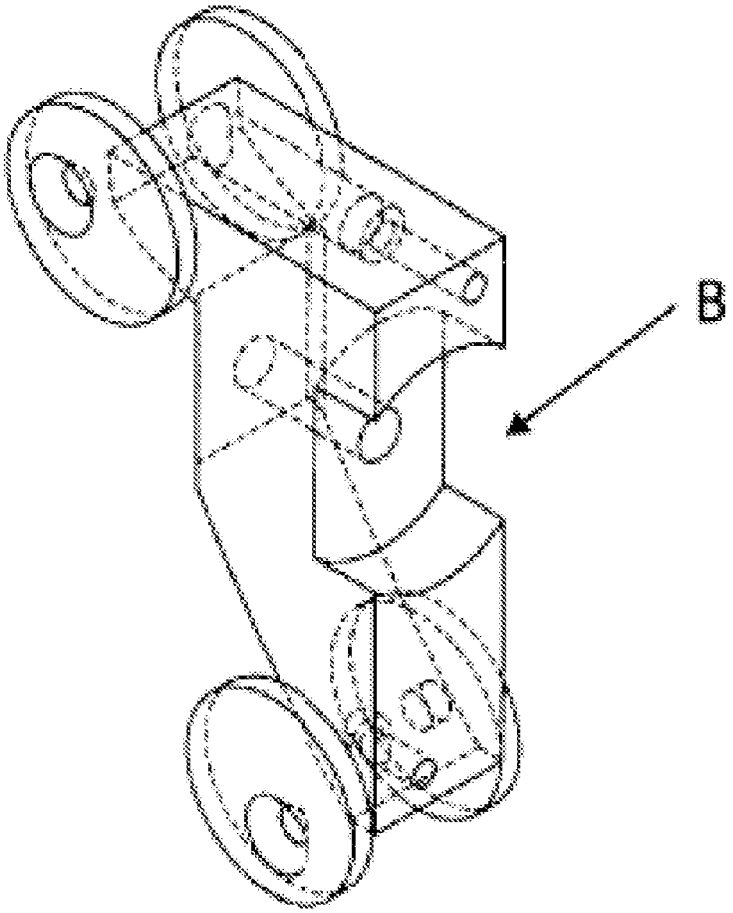
FIG. 3 is a transparent perspective view of the adapter housing of the FIG. 1 embodiment.
Figure 4:
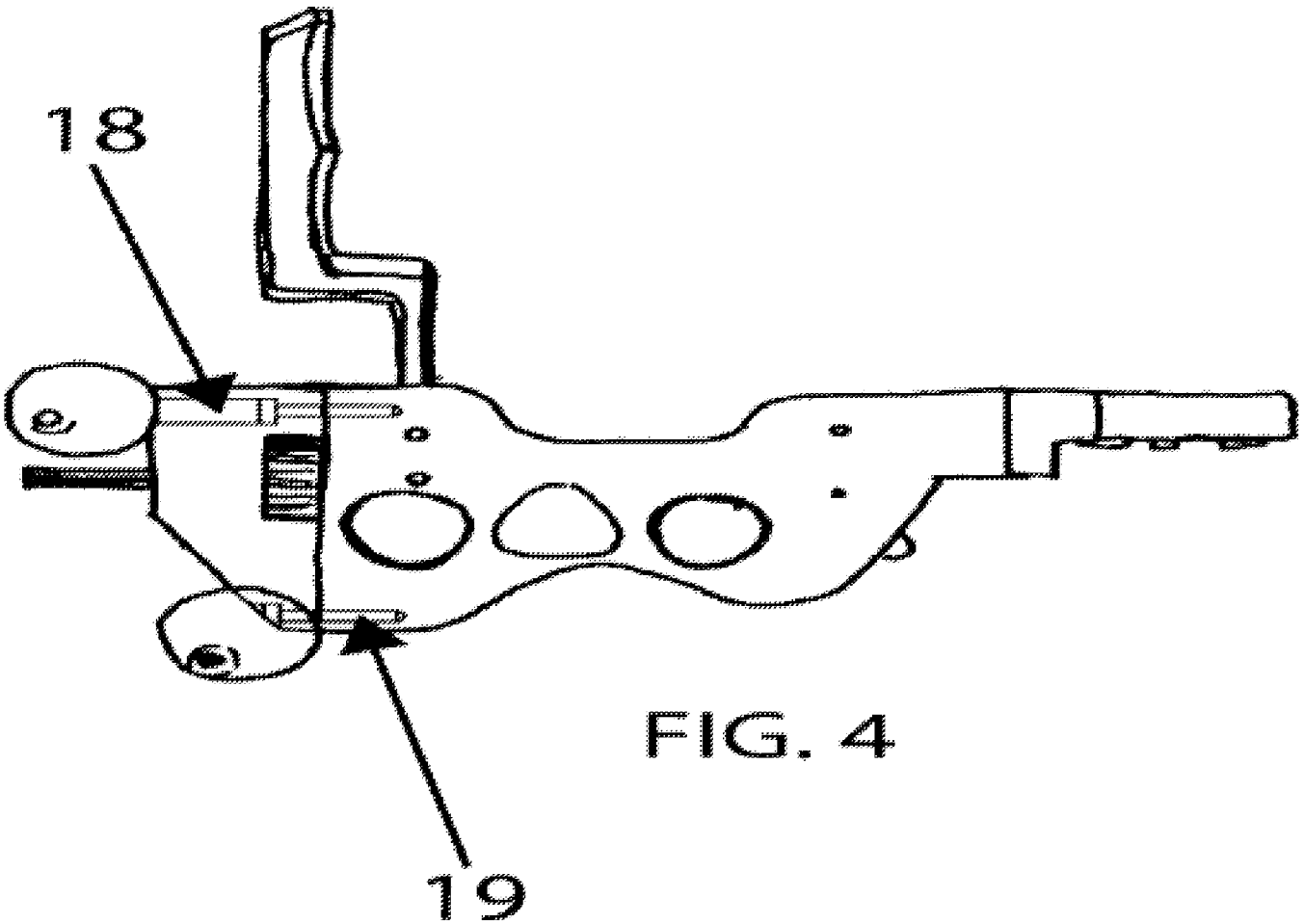
FIG. 4 is a side view of the body of the of the FIG. 1 embodiment.
Figure 5:
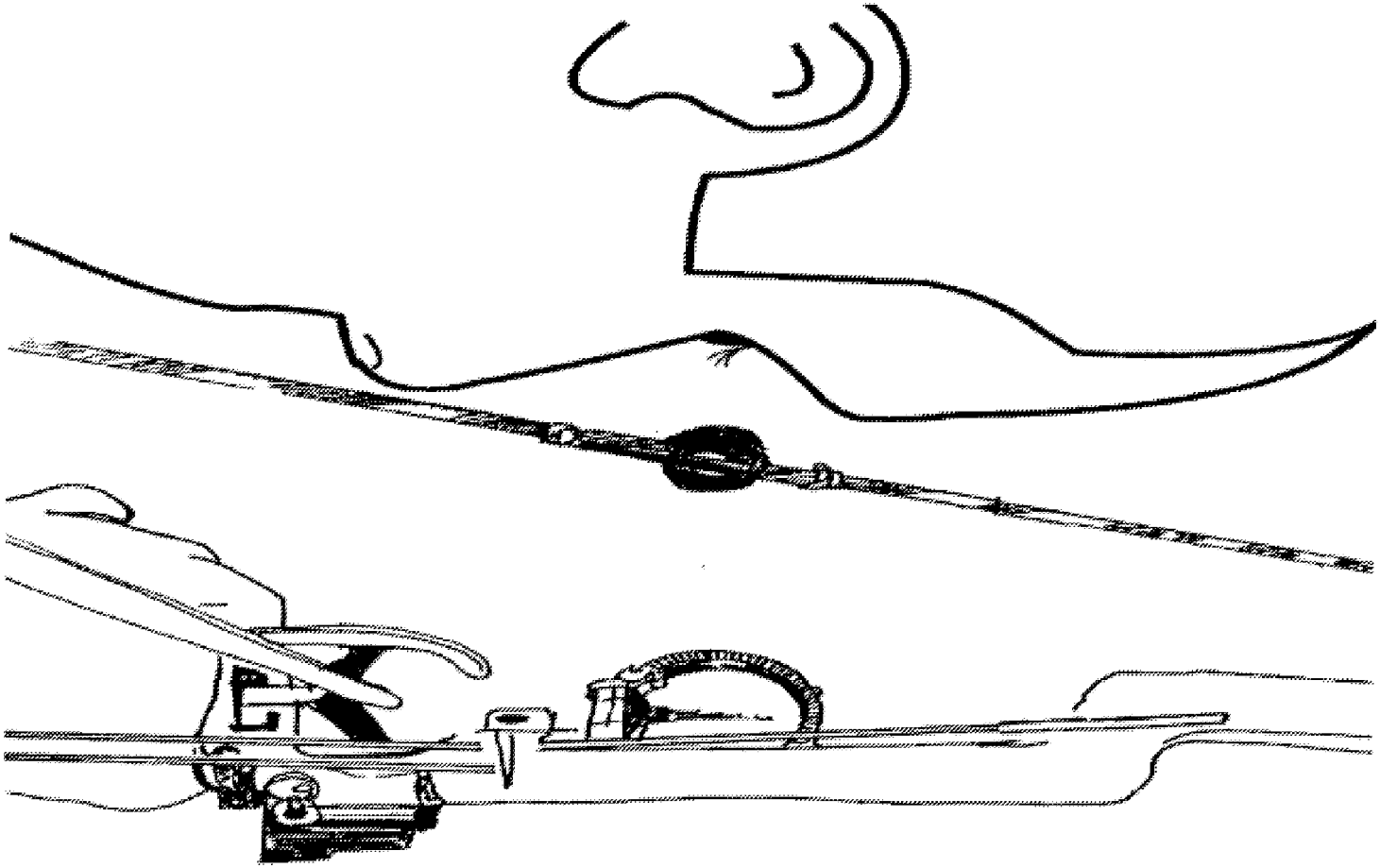
FIG. 5 illustrates the archery bow sights.
Figure 6:
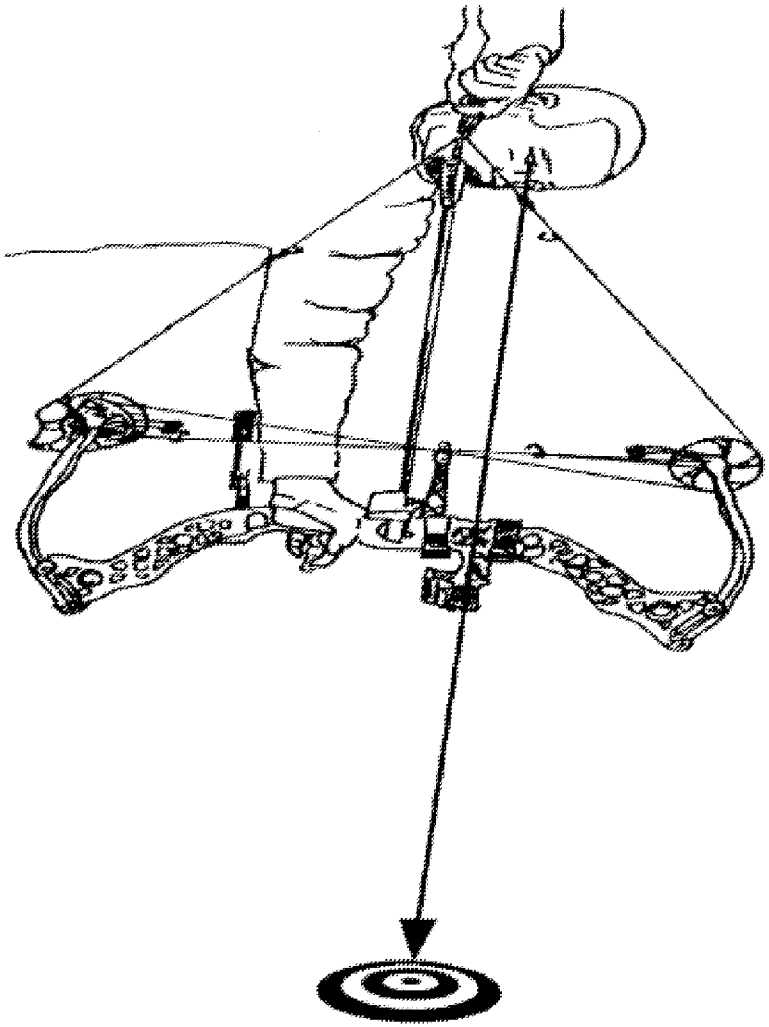
FIG. 6 illustrates the alignment of the front and rear sights of a bow at full draw.
Figure 7:
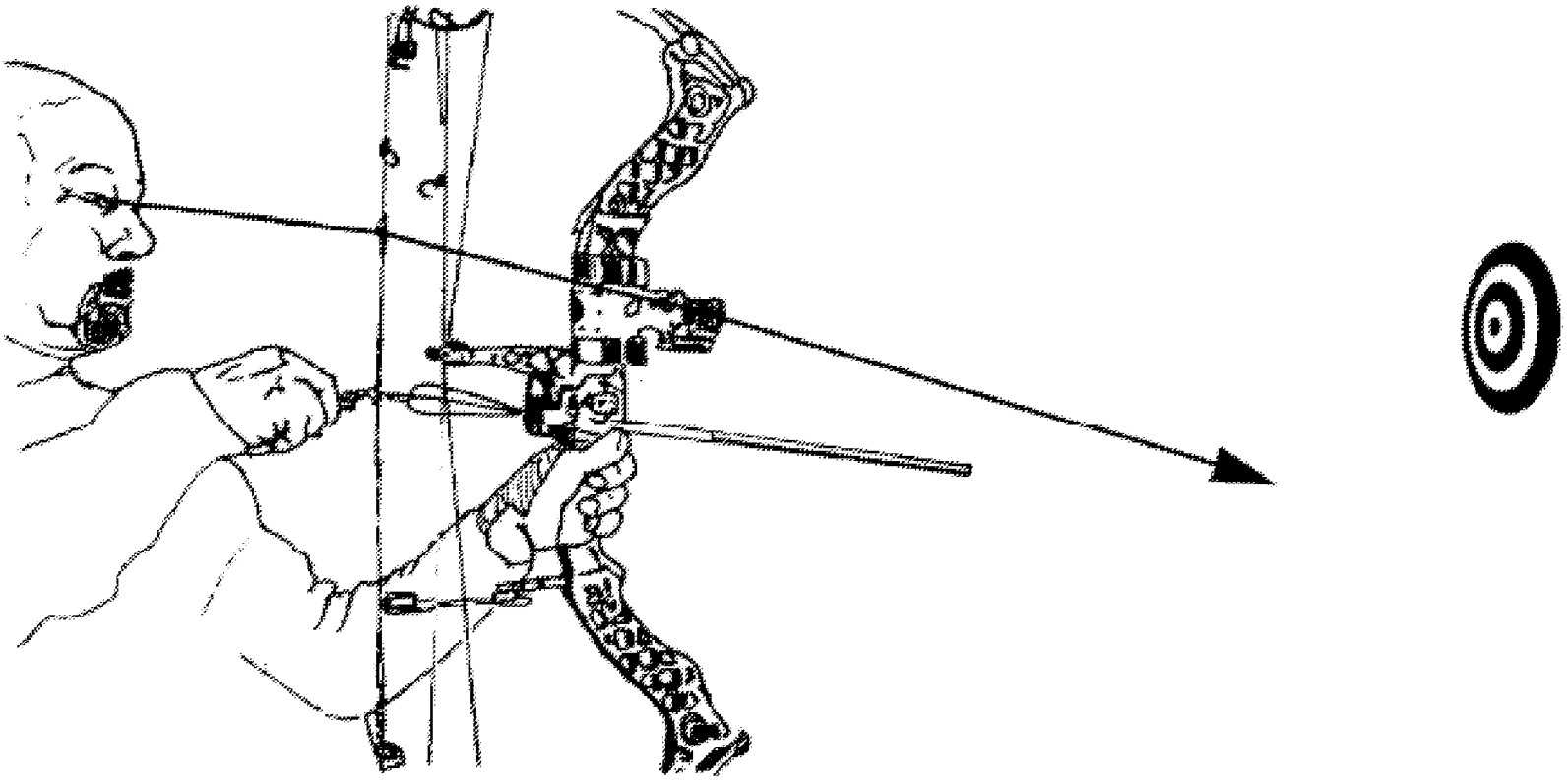
FIG. 7 illustrates the inability to align the front and rear sights of a bow while not at full draw.
Figure 8:
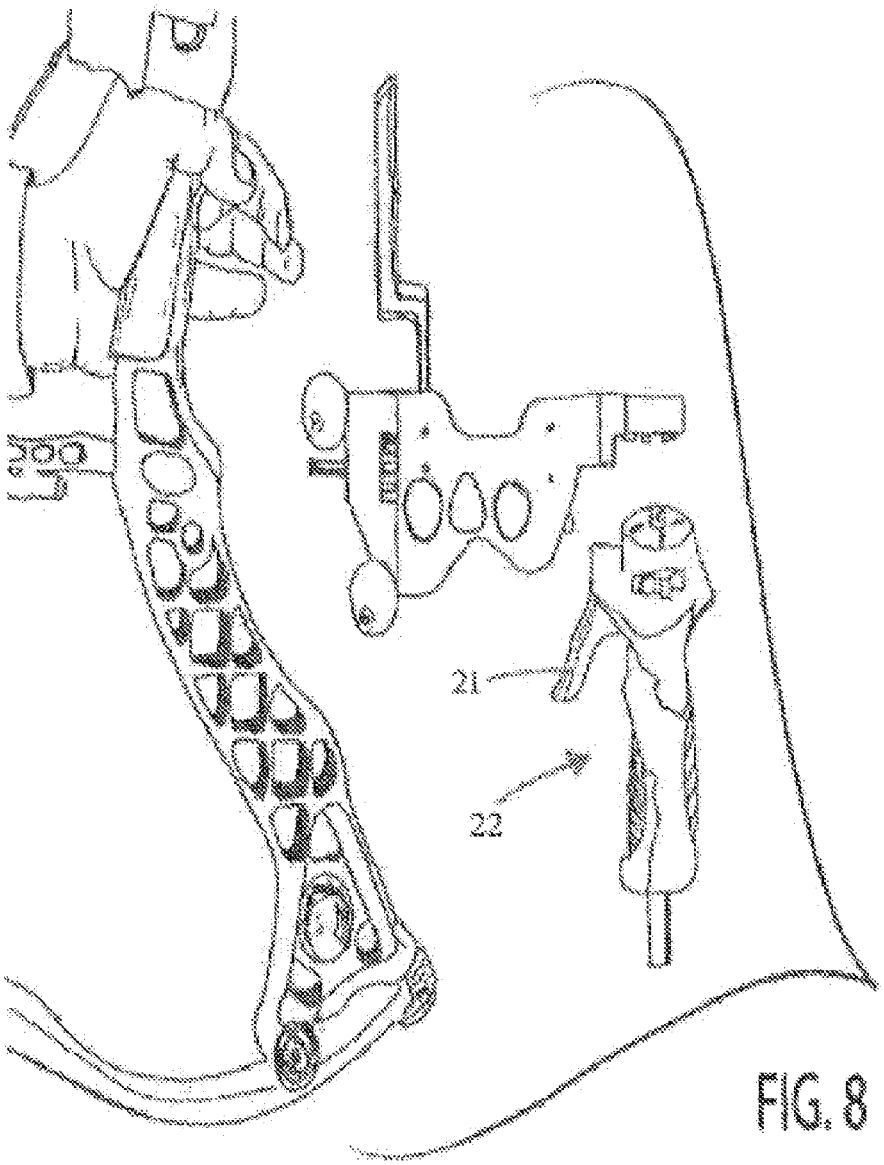
FIG. 8 is a partially exploded view showing the FIG. 1 embodiment of an Adjustable Archery Support System, an archery bow and an adjustable firearm shooting support.
Figure 9:
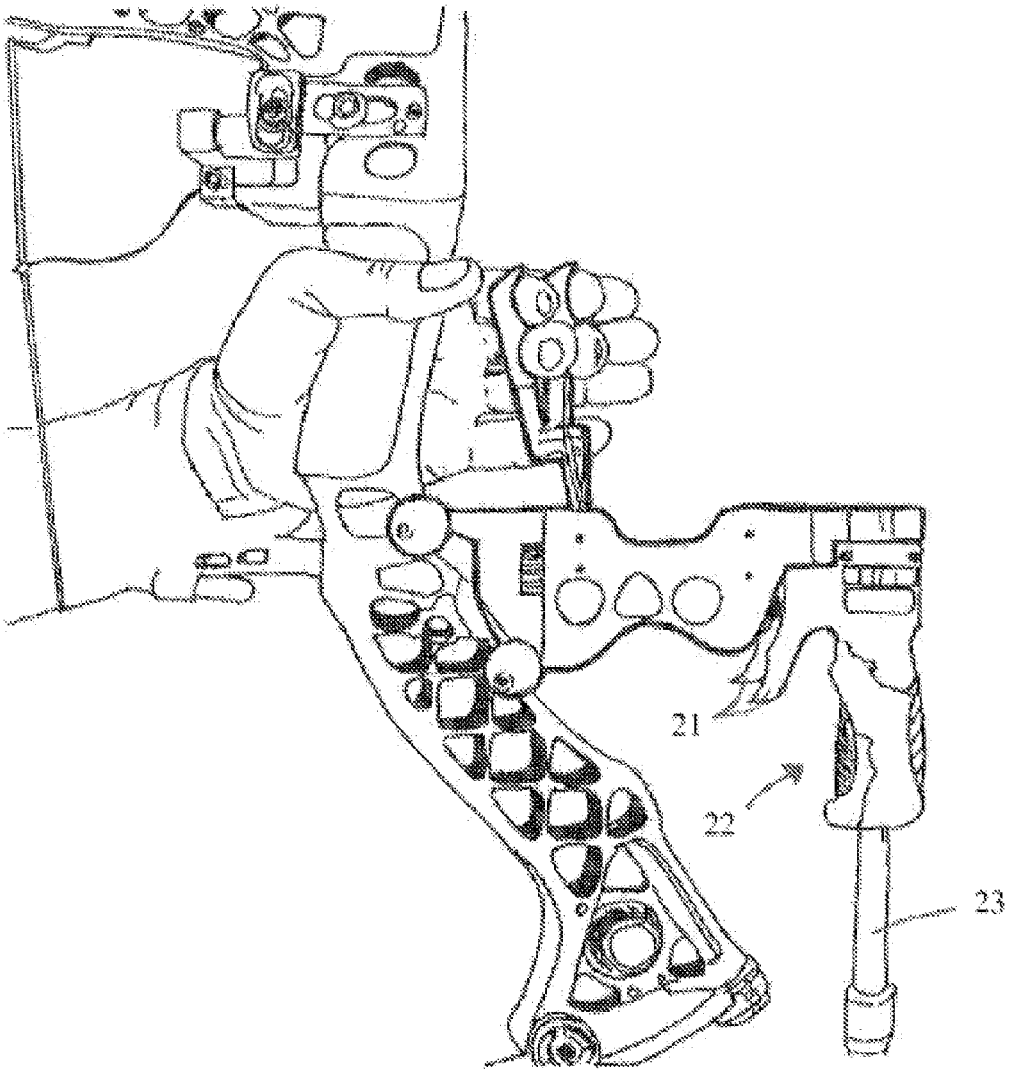
FIG. 9 shows the FIG. 1 embodiment of an Adjustable Archery Support System secured to a bow and to the firearm shooting support.

The Adjustable Archery Support System, according to the embodiment shown in FIGS. 1-11, includes two main housings, i.e., an actuator housing identified generally by the letter A in FIG. 2 and an adapter housing identified generally by the letter B in FIG. 3. The two housings A and B are connected by two screws 18 and 19, shown in FIGS. 1 and 4, one upper and one lower, which are accessed from the bow side of adapter housing B.

Actuator housing A internally includes actuator connecting linkage 6, actuator return spring 12, actuator lever 13 and lower actuator 4, upper pivot pins 15 and 16 and lower pivot pins 15*a* and 16*a*. Only two pins will be in use at a time, depending on whether lower actuator 4 is pushing or pulling. Pivot pins 15 and 15*a* are dowel pins, each which acts independently as an axle for actuator lever 13 for purposes of rotation. Pivot pins 15 and 15*a* are affixed to actuator housing A and actuator lever 13 is held in place by pivot pins 15 and 15*a* which are used alternatively depending on the requirements of the adjustable firearm shooting support as to whether activating the firearm shooting support requires a pushing or pulling action to obtain vertical adjustment.

Actuator housing A also includes upper connecting axle 3 which is pivotally interconnected to actuator lever 13 and lower connecting axle 5 which is pivotally interconnected to lower actuator 4. Spring 12 is disposed in return spring retaining barrel 14. Connecting linkage 6 also includes an adjustable firearm shooting support internal interface 20 located at the shooting support end of actuator housing A for the purpose of internally activating the vertical adjustability feature of the firearm shooting support.

Currently, the only adjustable firearm shooting support on the market is the Primos Trigger Stick and certain embodiments of an Adjustable Archery Support System are designed to complement this particular shooting support. When interfacing with the Primos Trigger Stick, an Adjustable Archery Support System will push the trigger of the Primos Trigger Stick when upper actuator lever 13 is activated. Pivot pin 15*a* is not used in conjunction with the Primos Trigger Stick, but is available if needed for other adjustable firearm shooting devices as they become available in the future.

Externally, actuator housing A includes openings, upper and lower, where actuator lever 13 and lower actuator 4 protrude from the housing. In addition, multiple detent connecting points 11 are formed on the support end of actuator housing A and are either concave or convex, as needed to connect to the adjustable firearm shooting support. Also, at the bottom of the support end of actuator housing A, threaded port 17*a* is disposed in the center of detents 111 for connection to the firearm shooting support.

Internally, adapter housing B includes thumb wheel 8 with threaded connecting shaft 8*a* which extends outwardly for connection to the archery bow. Adapter housing B externally features upper and lower antitwist anchoring discs 9 and 10 on both the right and left side which attach to the bow below the handle by means of antitwist anchoring fasteners 9*a* and 10*a* which pass through the riser of the bow and screw into threaded ports in the antitwist anchoring discs on the opposite side of the bow riser. The specific location depends on the make and model of the bow.

The exemplary Adjustable Archery Support System depicted in FIGS. 1-11 connects to the adjustable firearm shooting support by first removing the V-shaped firearm adapter from the top of the support and attaching the Adjustable Archery Support System by using the thumb screw on the adjustable firearm support 22 to screw into threaded port 17*a*. Detents 11 that surround threaded port 17*a* help to secure the Adjustable Archery Support System to the firearm shooting rest and prevent twisting during operation. Attachment is achieved by interconnection of threaded port 17*a* and manipulation of the thumb screw incorporated into adjustable firearm support 22. The thumb screw should be manually tightened as tight as is possible without using any tools. The archer must ensure that detents formed on the adjustable firearm support 22 line up with and engage with detents 11 on the exemplary Adjustable Archery Support System. This will also prevent twisting during operation.

Figure 10:
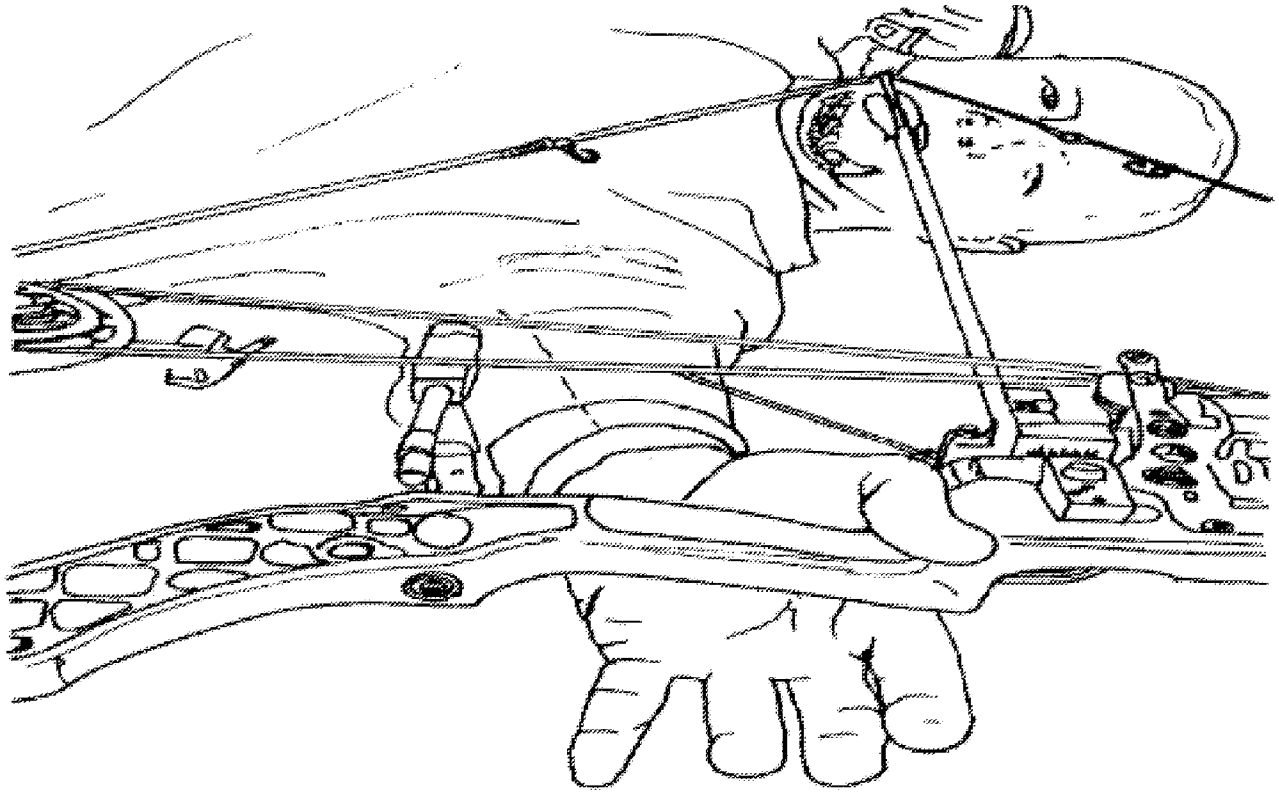
FIG. 10 shows the webbed space between the archer's thumb and index finger.

In operation, at full draw, the archer first reaches forward with the index and middle fingers on the forward or support hand, while the tension of the bow is held forward by allowing the bow to rest in the webbed space of the palm, between thumb and index finger, as shown in FIG. 10. Then the index and middle fingers are curled around upper actuator lever 13 and the archer gently pulls actuator lever 13 toward the bow which causes actuator lever 13 to rotate on pivot pin 15 which causes linkage 6 to move forward away from the bow. As this occurs, the movement of linkage 6 causes lower actuator 4 to rotate on pivot pin 16 through the interconnection between lower actuator 4, connecting axle 5 and linkage 6.

Figure 11:
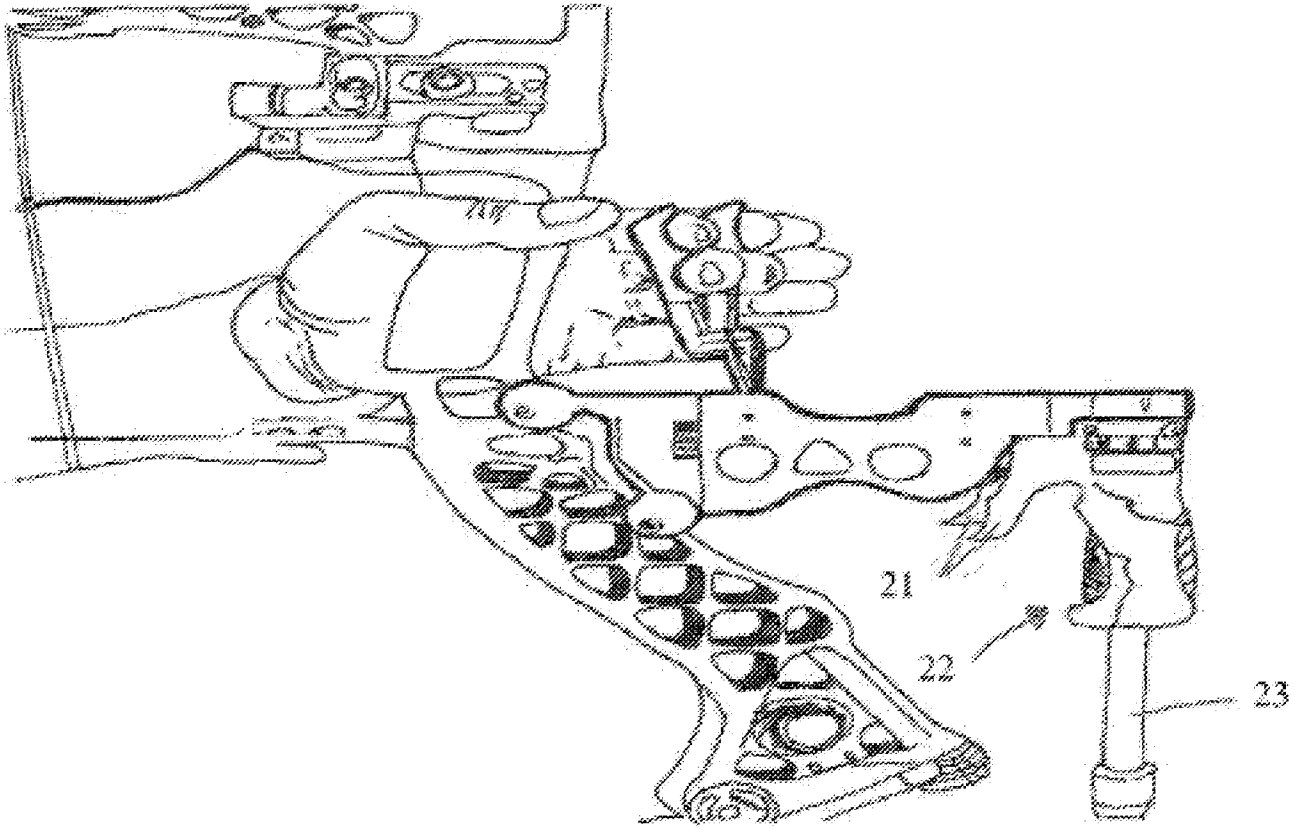
FIG. 11 is an enlarged view showing the archer's index and middle finger pulling the upper actuator according to an embodiment of an Adjustable Archery Support System.

As lower actuator 4 extends outwardly from actuator housing A, it pushes trigger 21 of adjustable firearm support 22, as shown in FIG. 11. This action in turn releases vertical rod 23 of adjustable firearm support 22 allowing the bow to move up and down and into the desired shooting position.

Once target and sight alignment is achieved, actuator lever 13 is released and spring 12 causes linkage 6 to withdraw causing lower actuator 4 to move away from trigger 21 thereby locking adjustable firearm shooting support 22 in position. The process of sight adjustment is repeated until alignment is perfect. Now the arrow can be released toward the target from a rest or supported position with much greater accuracy than from a nonsupported position. Accuracy is not the only benefit of being able to make full draw sighting adjustments. The lack of movement during the sighting process also saves time by decreasing the number of shots necessary to effectively sight in the bow as well as giving the archer much more confidence in the accuracy of the sight alignment process because he knows the bow was not moving during sighting since the shots were made from a supported or rest position.

Turning now to FIGS. 12-17, exemplary alternative embodiments of an Adjustable Archery Support System are shown and described. Notably, the exemplary embodiments illustrated in FIGS. 12-17, unlike the exemplary embodiment shown in FIGS. 1-11, envision a support rod 23B that does not include its own internal braking system. The support rod 23B may be adjustable in height via a fixed height adjustment mechanism 31, as would be understood by one of ordinary skill in the art, but use of the Adjustable Archery Support System does not rely on adjustment of the support rod 23B height. Rather, use of the exemplary Adjustable Archery Support System embodiments illustrated in FIGS. 12-17 rely on adjustment of the location of the particular Adjustable Archery Support System embodiment up and down the exterior of the support rod 23B.

Figure 12:
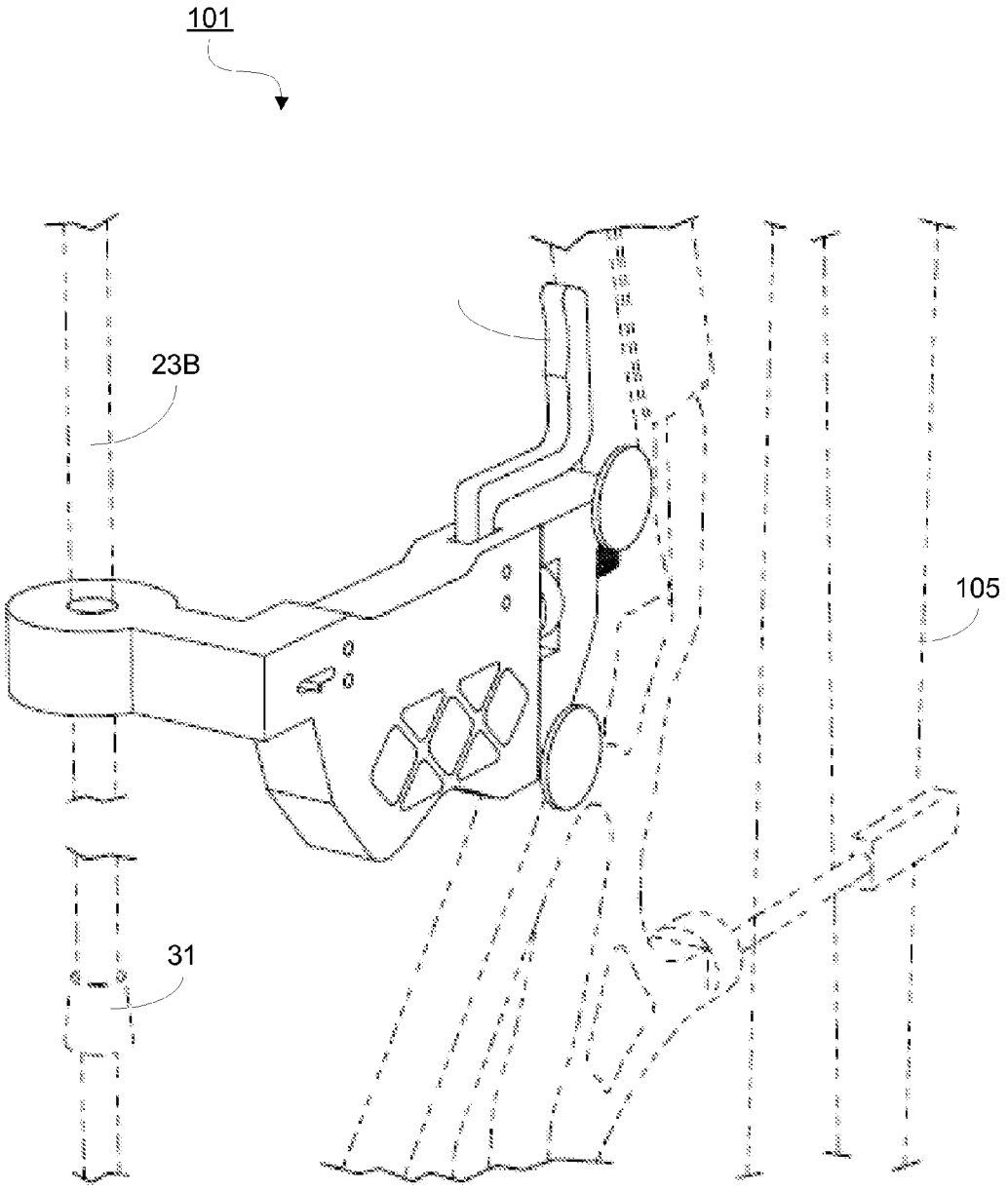
FIG. 12 illustrates an exemplary embodiment of an Adjustable Archery Support System with an offset support rod.

FIG. 12 illustrates an exemplary embodiment 101 of an Adjustable Archery Support System with an offset support rod 23B. Notably, it is an advantage of the embodiment 101 that the support rod 23B is offset from the sight line of an archer seeking to aim the bow to which the embodiment 101 is attached. That is, because the support rod 23B is offset relative to the bow and upper actuation trigger 13B, the sight line of an archer aiming the bow is not impeded, as would be understood by one of ordinary skill in the art of archery.

The basic operation of the embodiment 101 is similar to that previously described relative to FIGS. 1-11. In operation, the user of the bow actuates lever 13B which, in turn, translates the force through a linkage arrangement housed within the embodiment 101. The translated force is used to release a brake component such that the bow may be raised or lowered relative to the ground. Once the bow is adjusted relative to the ground, the user may release the lever 13B, thereby allowing the linkage to return to a normal "failed closed" state that reengages the brake. More detail regarding exemplary braking and linkage arrangements that may be comprised within an Adjustable Archery Support System with an offset support rod 23B are shown and described in subsequent figures.

Figure 13:
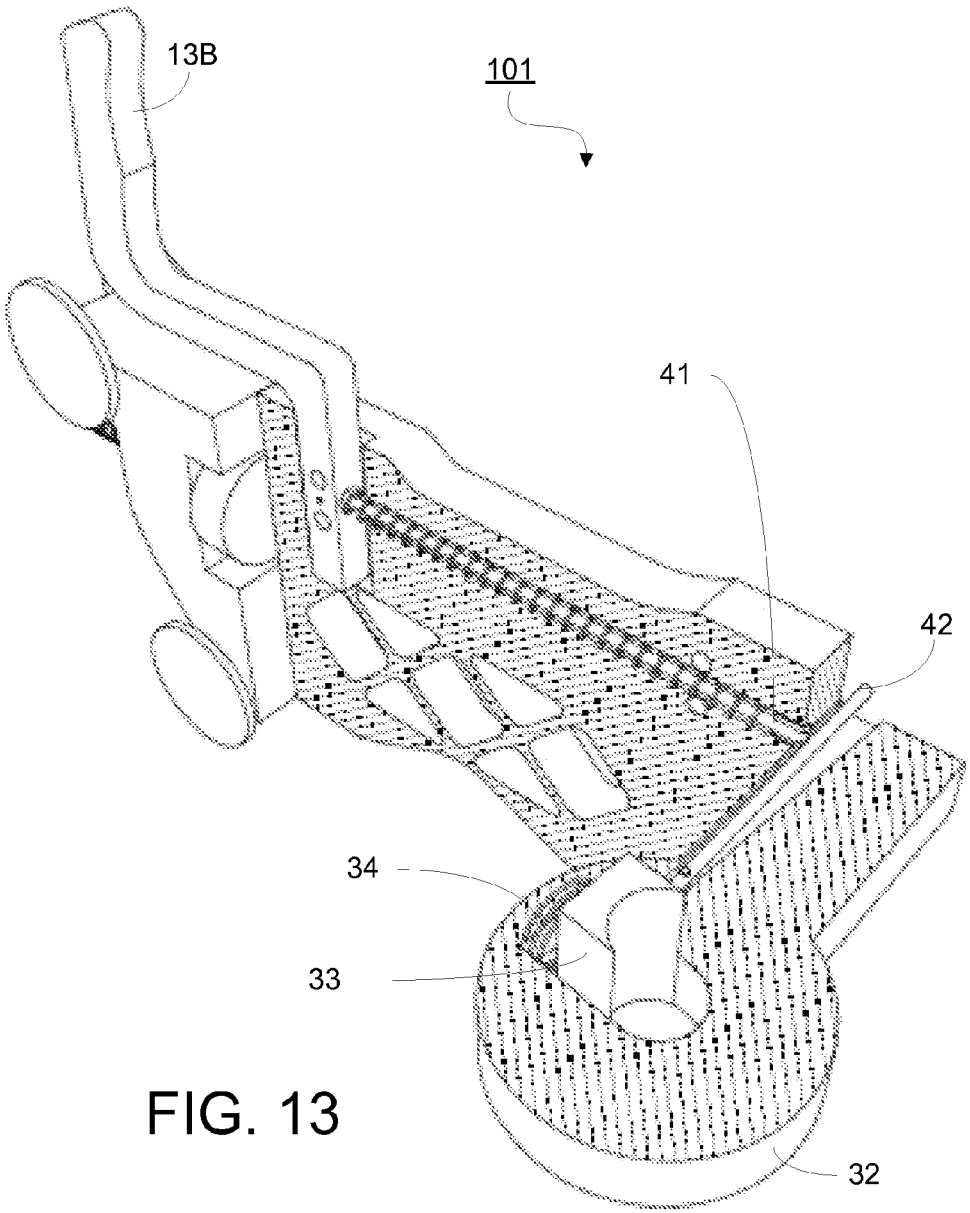
FIG. 13 is a cutaway view of the exemplary embodiment of an Adjustable Archery Support System with an offset support rod shown in FIG. 12, shown in a fail closed state.

FIG. 13 is a cutaway view of the exemplary embodiment 101 of an Adjustable Archery Support System with an offset support rod 23B shown in FIG. 12, shown in a fail closed state. As can be seen in the FIG. 13 illustration, the exemplary embodiment 101 includes a brake housing 32 with an internal brake 33. Briefly referring back to the FIG. 12 illustration, a support rod 23B may extend through brake housing 32 such that internal brake 33 is positioned to interface with the exterior of support rod 23B.

In addition to the internal brake 33, the brake housing 32 may also include a compression spring 34 having a "k" constant sufficient to generate a force useful for pushing internal brake 33 against the exterior surface of support rod 23B (not shown). When the compression spring 34 is allowed to move towards its steady state, the spring 34 may generate enough force such that the weight of a bow will not cause the internal brake 33 to slip relative to support rod 23B. It is envisioned that the internal brake 33 may be constructed from any material suitable for creating enough friction as to effectively prevent the internal brake 33 from slipping on the support post 23B when it is engaged against the exterior surface of the support post 23B.

As can be seen in the FIG. 13 illustration (as well as the FIGS. 12 and 14-17 illustrations), the brake housing 32 may be offset relative to the direction of a force generated by actuation of actuation trigger 13B such that a support rod 23B may be positioned substantially outside a plane defined by the bow or bowstring 105, as would be evident to one of ordinary skill in the art viewing the FIG. 12-17 illustrations. As such, a linkage arrangement comprised within an embodiment of an Adjustable Archery Support System with an offset brake housing 32 (and, therefore, an offset support rod 23B) may be operable to translate a force generated by actuation trigger 13B to a substantially parallel vector that is offset from a plane defined by the vertical bowstring 105 (see FIG. 12).

The exemplary lever-based linkage arrangement depicted in the FIG. 13 illustration includes a main push rod 41 that at its proximate end mechanically interfaces with the upper actuation trigger lever 13B and, at its distal end, mechanically interfaces with a horizontal lever 42. The horizontal lever 42 is operable to pivot on a pivot pin 43 (labeled in FIG. 15) such that it adjusts the position of internal brake 33 (compresses spring 34). In the FIG. 13 illustration, the upper actuation trigger 13B is in its normal position and, as such, no force is being translated through the linkage. The compression spring 34 is extended such that internal brake 33 would be engaged to a support rod 23B if present.

Figure 14:
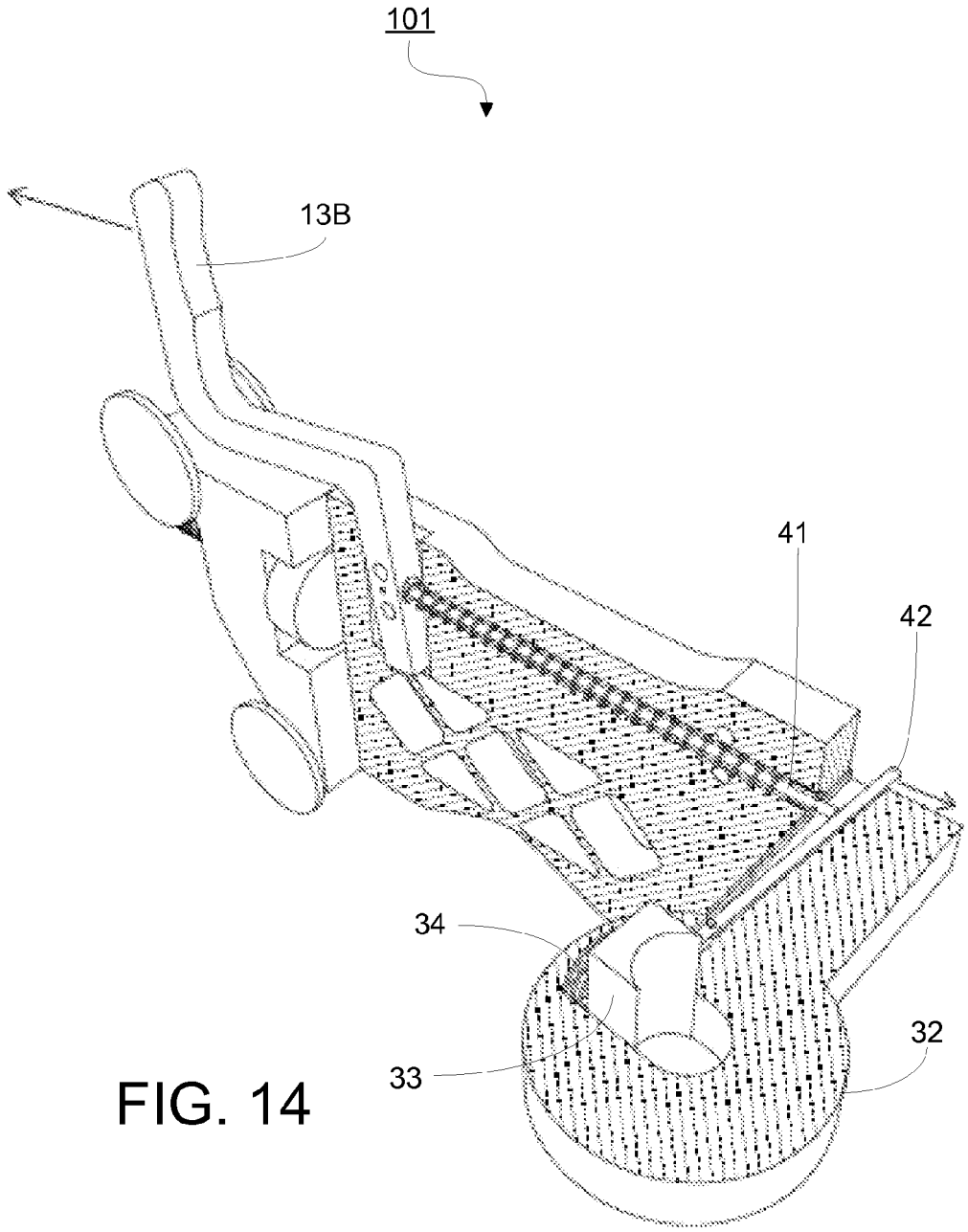
FIG. 14 is a cutaway view of the exemplary embodiment of an Adjustable Archery Support System with an offset support rod shown in FIG. 12, shown in an actuated open state.

FIG. 14 is a cutaway view of the exemplary embodiment 101 of an Adjustable Archery Support System with an offset support rod 23B shown in FIG. 12, shown in an actuated open state. As is represented by the upper arrow in the FIG. 14 illustration, a force may be applied to the upper actuation trigger 13B by the user of a bow. The force is translated through the trigger 13B and applied to the main push rod 41 which, in turn, applied a force at is distal end to a horizontal push rod 42 (as represented by the lower arrow in the FIG. 14 illustration). The horizontal push rod 42 pivots on pivot pin 43 such that internal brake 33 is retracted from a support rod 23B if present. Notably, retracting internal brake 33 from its normal position requires a force capable of compressing the compression spring 34. With the internal brake 33 retracted, the brake housing 32 may be slidably positioned up or down the support rod 23B.

Figure 15:
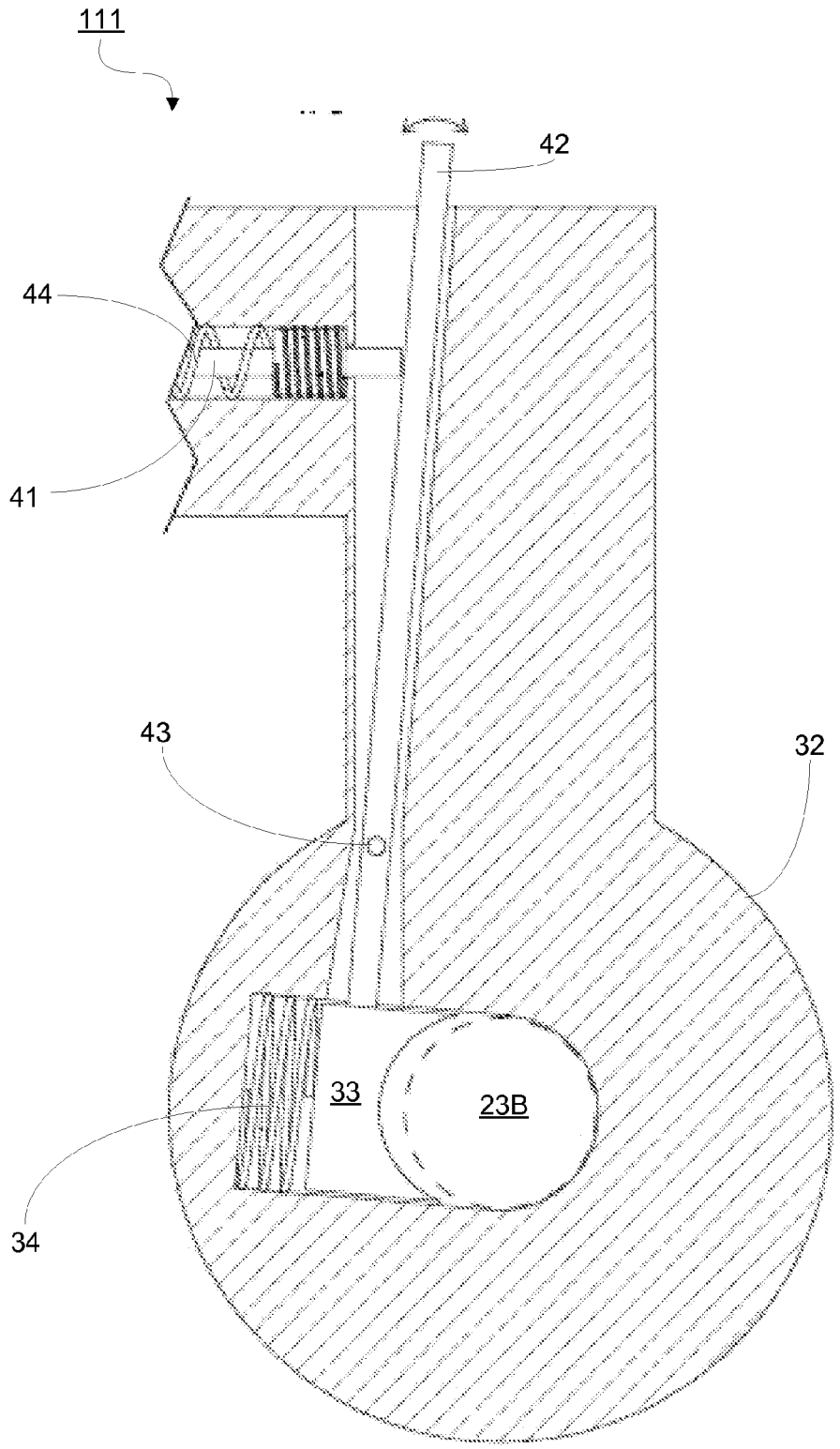
FIG. 15 is a detailed view of the lever-based linkage arrangement illustrated in FIGS. 13 and 14.

FIG. 15 is a detailed view of the lever-based linkage arrangement 111 illustrated in FIGS. 13 and 14, shown in an actuated open state. As previously described, the user of a bow that is attached to the exemplary Adjustable Archery Support System may have applied a force to the upper actuation lever 13B by "squeezing" the lever 13B. As a result, the force may have translated through the main push rod 41 such that horizontal push rod 42 is translated forward to pivot at pivot pin 43. Consequently, the internal brake 33 may have been retracted from its normal position in contact with the support rod 23B, thereby allowing the entire system to be slidably positioned up or down along the exterior surface of the support rod 23B. In this actuated open state, the compression spring 34 may be further compressed so that once the actuation force on the upper actuation lever 13B is released, the compression spring 34 is allowed to extend and force the internal brake 33 back into contact with the support rod 23B. With the internal brake 33 in contact with the support post 23B, the bow may be anchored to the support post 23B and stabilized by virtue of the support post 23B being in contact with the ground. Notably, the exemplary embodiment also includes a tension spring 44 operable to urge the main push rod 41 back to reset the upper actuation trigger 13B.

Figure 16:
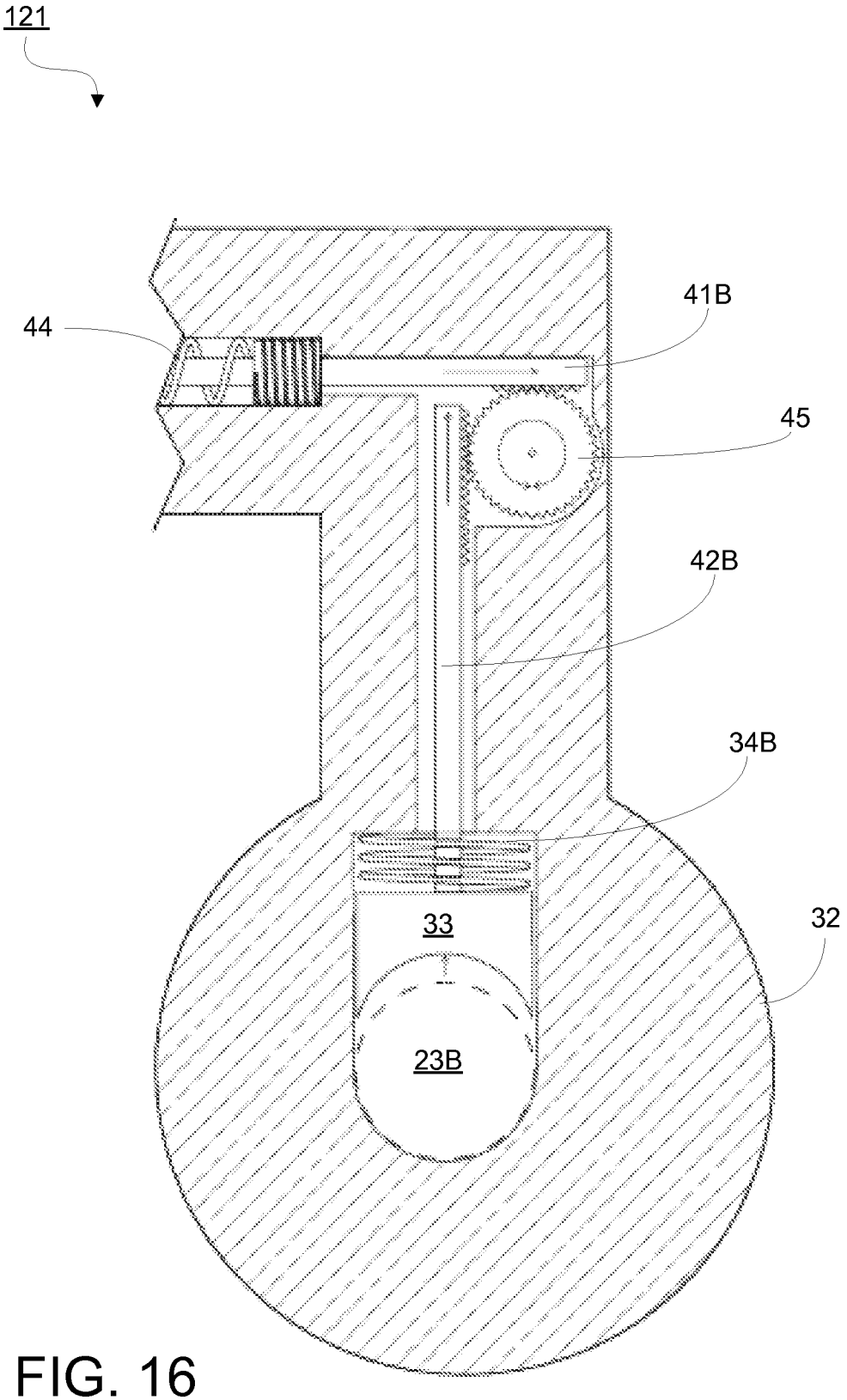
FIG. 16 is a detailed view of an exemplary gear-based linkage arrangement that may be comprised within a given embodiment of an Adjustable Archery Support System.

FIG. 16 is a detailed view of an exemplary gear-based linkage arrangement 121 that may be comprised within a given embodiment of an Adjustable Archery Support System. Notably, as can be understood from the FIG. 16 illustration, certain embodiments of an Adjustable Archery Support System may include a linkage arrangement with an offset brake housing 32 (and, therefore, an offset support rod 23B) that is configured to translate a force generated by actuation trigger 13B to a substantially perpendicular vector relative to a plane defined by the vertical bowstring 105 (see FIG. 12).

The main push rod 41B and horizontal push rod 42B may each include a rack aspect that engages with a gear 45. As the main push rod 41B is translated forward relative to the bow, its rack engages with gear 45 and rotates it clockwise. The gear 45, in turn, engages with the rack aspect of horizontal push rod 42B and causes it to retract internal brake 33 from support post 23B. Compression spring 34B is compressed and the offset brake housing 32 may be slidably positioned up or down. Next, the upper actuation lever 13B may be released and urged back to its normal position via tension spring 44 and/or via counterclockwise rotation of gear 45 resulting from expansion of compression spring 34B. The internal brake 33 may at that time reengage with support post 23B.

Figure 17:
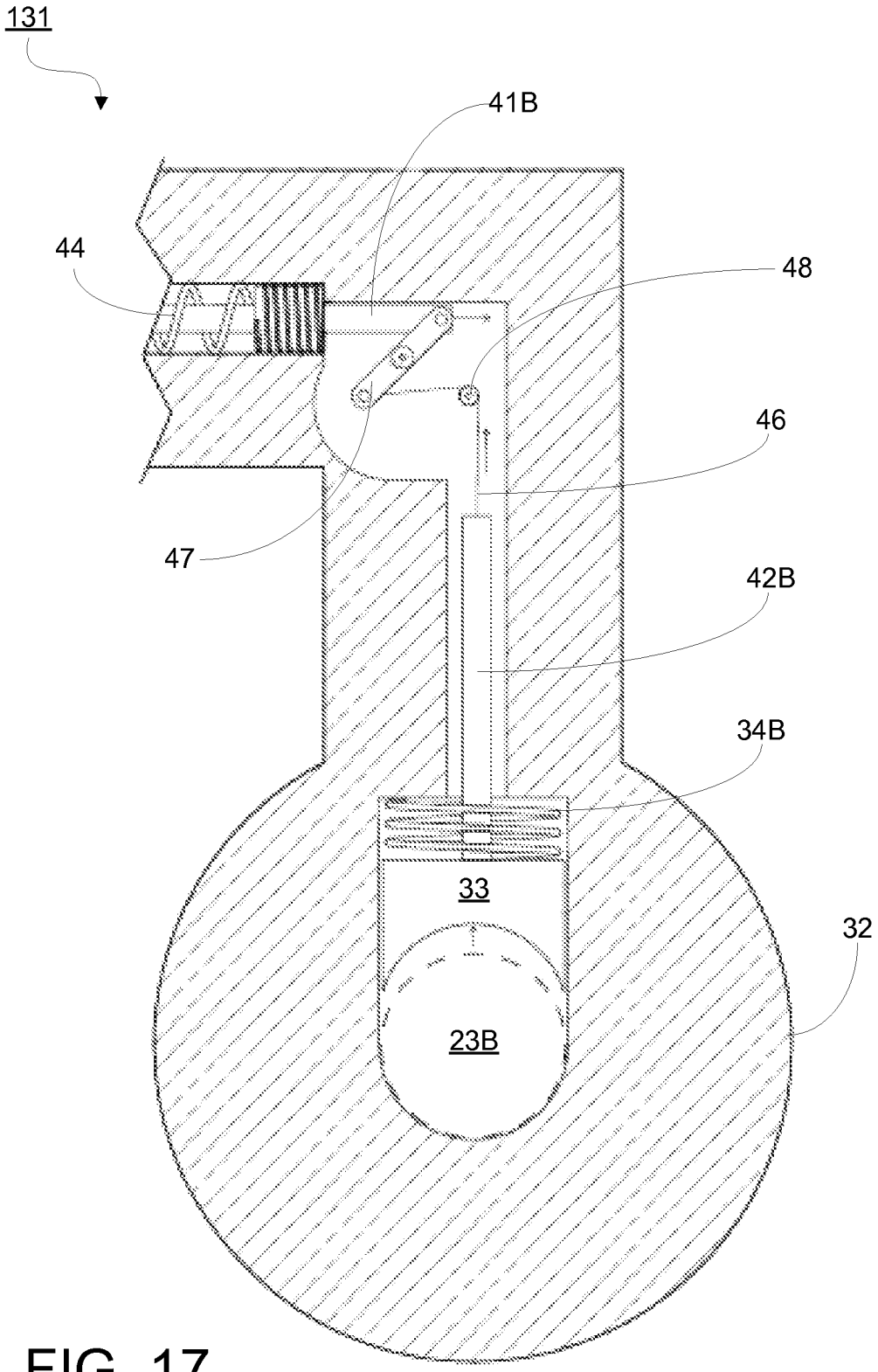
FIG. 17 is a detailed view of an exemplary cable-based linkage arrangement that may be comprised within a given embodiment of an Adjustable Archery Support System.

FIG. 17 is a detailed view of an exemplary cable-based linkage arrangement 131 that may be comprised within a given embodiment of an Adjustable Archery Support System. Notably, as can be understood from the FIG. 17 illustration, certain embodiments of an Adjustable Archery Support System may include a linkage arrangement with an offset brake housing 32 (and, therefore, an offset support rod 23B) that is configured to translate a force generated by actuation trigger 13B to a substantially perpendicular vector relative to a plane defined by the vertical bowstring 105 (see FIG. 12).

The main push rod 41B and horizontal push rod 42B may be mechanically connected via a cable 46 and lever arm 47. As the main push rod 41B is translated forward relative to the bow, it pushes lever arm 47 and rotates it clockwise. The lever arm 47, in turn, pulls a cable 46 around a pivot roller 46 to pull horizontal push rod 42B. Pulling horizontal push rod 42B causes internal brake 33 to retract from support post 23B. Compression spring 34B is compressed and the offset brake housing 32 may be slidably positioned up or down. Next, the upper actuation lever 13B may be released and urged back to its normal position via tension spring 44 and/or via counterclockwise rotation of lever arm 47 resulting from expansion of compression spring 34B. The internal brake 33 may at that time reengage with support post 23B.

An Adjustable Archery Support System has been described using detailed descriptions of embodiments thereof that are provided by way of example and are not intended to limit the scope of the disclosure. The described embodiments comprise different features, not all of which are required in all embodiments of an Adjustable Archery Support System. Some embodiments of an Adjustable Archery Support System utilize only some of the features or possible combinations of the features. Variations of embodiments of an Adjustable Archery Support System that are described and embodiments of an Adjustable Archery Support System comprising different combinations of features noted in the described embodiments will occur to persons of the art.

It will be appreciated by persons skilled in the art that an Adjustable Archery Support System is not limited by what has been particularly shown and described herein above. Rather, the scope of an Adjustable Archery Support System is defined by the claims that follow.

The invention claimed is:

1. An adjustable archery support system comprising:

a non-telescoping support post;

an adapter configured to mount on a riser of an archery bow such that the adjustable archery support system is positioned ahead of the archery bow relative to an archer using the archery bow;

an offset brake housing for mechanically interfacing the adjustable archery support system to the non-telescoping support post, wherein the offset brake housing comprises an internal brake operable to engage the non-telescoping support post on its exterior surface; and an actuator housing disposed between the adapter and the offset brake housing, the actuator housing comprising:

a first actuator lever pivotally connected to the actuator housing and extending upwardly and outwardly therefrom such that it is positioned above an uppermost horizontal plane defined by the actuator housing when the adjustable archery support system is mounted via the adapter on the riser of the archery bow; and a mechanical linkage contained within the actuator housing, wherein the mechanical linkage is connected to the first actuator lever at one end and to the internal brake at the other end;

wherein actuation of the first actuator lever amplifies an actuation force and, via the mechanical linkage, causes actuation of the internal brake;

wherein the non-telescoping in support cost extends through the offset brake housing and above the uppermost horizontal plane defined by the actuator housing such that the offset brake housing is prevented from pivoting relative to the non-telescoping support post; and wherein the offset brake housing positions the support post substantially to a side of the archery bow.

2. The adjustable archery support system of claim 1, wherein the linkage comprises a lever.

3. The adjustable archery support system of claim 1, wherein the linkage comprises a gear.

4. The adjustable archery support system of claim 1, wherein the linkage comprises a cable.

5. The adjustable archery support system of claim 1, wherein the adapter is configured to mount on the riser by threadably interconnecting to a threaded stabilizer port.

6. The adjustable archery support system of claim 1, further comprising a pair of spaced antitwist discs interconnected to the adapter and disposed to mechanically interface with either side of an archery bow.

7. The adjustable archery support system of claim 1, wherein the first actuator lever is pivotally connected to the actuator housing by means of a first pivot pin.

* * * * *